US010329861B2

(12) United States Patent
Weckend et al.

(10) Patent No.: US 10,329,861 B2
(45) Date of Patent: Jun. 25, 2019

(54) LINER RUNNING TOOL AND ANCHOR SYSTEMS AND METHODS

(71) Applicants: Carsten Weckend, Celle (DE); Heiko Eggers, Bad Fallingbostel (DE); Fabian Mau, Vechelde (DE); Henning Melles, Celle (DE); Ingo Roders, Seelze (DE); Henning Rahn, Celle (DE); Frauke Osterkamp, Celle (DE)

(72) Inventors: Carsten Weckend, Celle (DE); Heiko Eggers, Bad Fallingbostel (DE); Fabian Mau, Vechelde (DE); Henning Melles, Celle (DE); Ingo Roders, Seelze (DE); Henning Rahn, Celle (DE); Frauke Osterkamp, Celle (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 128 days.

(21) Appl. No.: 15/277,280

(22) Filed: Sep. 27, 2016

(65) Prior Publication Data

US 2018/0087335 A1 Mar. 29, 2018

(51) Int. Cl.

| | |
|---|---|
| ***E21B 23/01*** | (2006.01) |
| ***E21B 43/10*** | (2006.01) |
| ***E21B 47/09*** | (2012.01) |

(52) U.S. Cl.

CPC ..... *E21B 23/01* (2013.01); *E21B 43/10* (2013.01); *E21B 47/09* (2013.01)

(58) Field of Classification Search

CPC ..... E21B 23/01; E21B 43/10

See application file for complete search history.

(56) References Cited

U.S. PATENT DOCUMENTS

| | | | | |
|---|---|---|---|---|
| 4,256,180 A * | 3/1981 | Mott | E21B 23/08 166/153 |
| 4,463,814 A | 8/1984 | Horstmeyer et al. | |
| 4,745,974 A * | 5/1988 | Higgins | E21B 34/105 166/125 |
| 5,390,739 A * | 2/1995 | Tailby | E21B 23/02 166/212 |

(Continued)

FOREIGN PATENT DOCUMENTS

| | | |
|---|---|---|
| WO | 2015019147 A1 | 2/2015 |
| WO | 2015094317 A1 | 6/2015 |

OTHER PUBLICATIONS

"Excalibre Downhole Torque Anchor (EDT)", Excalibre Downhole Tools Ltd., [Retrieved via internet on Jan. 17, 2018: http://excalibretools.com/torque-anchors/excalibre-downhole-torque-anchor/]; 1 page.

(Continued)

*Primary Examiner* — Shane Bomar

(74) *Attorney, Agent, or Firm* — Cantor Colburn LLP

(57) ABSTRACT

System and methods for engaging and disengaging running tools with a liner in a downhole system are described herein. The system and methods include a liner disposed in a borehole, the liner having at least one running tool engagement section, a running tool disposed within the liner, the running tool having at least one engagement module that is operable from a disengaged position to an engaged position and that is operable from an engaged position to a disengaged position, and an electronic device disposed at least one of in or on the engagement module.

21 Claims, 10 Drawing Sheets

(56) References Cited

U.S. PATENT DOCUMENTS 6,138,756 A * 10/2000 Dale ..... E21B 29/00 166/117.5
7,784,552 B2 8/2010 Brouse
9,004,195 B2 4/2015 Regener et al.
2002/0000319 A1* 1/2002 Brunet ..... E21B 23/002 166/313
2009/0071659 A1 3/2009 Spencer et al.
2009/0101362 A1 4/2009 Loughlin
2011/0024194 A1 2/2011 Servaes et al.
2011/0061876 A1* 3/2011 Johnson ..... E21B 19/22 166/386
2012/0186874 A1 7/2012 Malone et al.
2013/0126165 A1* 5/2013 Themig ..... E21B 41/0035 166/285
2013/0306374 A1* 11/2013 Wood ..... E21B 47/122 175/40
2014/0054036 A1* 2/2014 Regener ..... E21B 33/14 166/285
2014/0338896 A1* 11/2014 McGarian ..... E21B 47/0005 166/250.08
2015/0136393 A1* 5/2015 Turley ..... E21B 43/10 166/285
2015/0136394 A1* 5/2015 Turley ..... E21B 43/10 166/285
2017/0030157 A1* 2/2017 Hansen ..... E21B 49/081
2017/0370189 A1* 12/2017 MacDougall ..... E21B 41/00

OTHER PUBLICATIONS

International Search Report and Written Opinion, International Application No. PCT/US2017/053386, dated Jan. 9, 2018, Korean Intellectual Property Office; International Search Report 3 pages, Written Opinion 7 pages.

* cited by examiner

LINER RUNNING TOOL AND ANCHOR SYSTEMS AND METHODS

BACKGROUND

1. Field of the Invention

The present invention generally relates to running tools and anchor systems and methods of use for downhole tools and/or downhole components.

2. Description of the Related Art

Boreholes are drilled deep into the earth for many applications such as carbon dioxide sequestration, geothermal production, and hydrocarbon exploration and production. In all of the applications, the boreholes are drilled such that they pass through or allow access to a material (e.g., a gas or fluid) contained in a formation located below the earth's surface. Different types of tools and instruments may be disposed in the boreholes to perform various tasks and measurements.

In more detail, wellbores or boreholes for producing hydrocarbons (such as oil and gas) are drilled using a drill string that includes a tubing made up of, for example, jointed tubulars or continuous coiled tubing that has a drilling assembly, also referred to as the bottom hole assembly (BHA), attached to its bottom end. The BHA typically includes a number of sensors, formation evaluation tools, and directional drilling tools. A drill bit attached to the BHA is rotated with a drilling motor in the BHA and/or by rotating the drill string to drill the wellbore. While drilling, the sensors can determine several attributes about the motion and orientation of the BHA that can be used, for example, to determine how the drill string will progress. Further, such information can be used to detect or prevent operation of the drill string in conditions that are less than favorable.

A well, e.g., for production, is generally completed by placing a casing (also referred to herein as a "liner" or "tubular") in the wellbore. The spacing between the liner and the wellbore inside, referred to as the "annulus," is then filled with cement. The liner and the cement may be perforated to allow the hydrocarbons to flow from the reservoirs to the surface via a production string installed inside the liner. Some wells are drilled with drill strings that include an outer string that is made with the liner and an inner string that includes a drill bit (called a "pilot bit"), a bottomhole assembly, and a steering device. The inner string is placed inside the outer string and securely attached therein at a suitable location. The pilot bit, bottomhole assembly, and steering device extend past the liner to drill a deviated well. The pilot bit drills a pilot hole that is enlarged by a reamer bit attached to the bottom end of the liner. The liner is then anchored to the wellbore. The inner string is pulled out of the wellbore and the annulus between the wellbore and the liner is then cemented.

The disclosure herein provides improvements to drill strings and methods for using the same to drill a wellbore and cement the wellbore during a single trip.

SUMMARY

Disclosed herein are systems and methods for engaging and disengaging running tools with a liner in a downhole system. The systems and methods include a liner disposed in a borehole, the liner having at least one running tool engagement section, a running tool disposed within the liner, the running tool having at least one engagement module that is operable from a disengaged position to an engaged position and that is operable from an engaged position to a disengaged position, and an electronics module, electronics components, and/or electronics device(s) disposed at least one of in or on the engagement module.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Disclosed are methods, apparatus, and systems for repeated engagement of a running tool with a liner at multiple positions within the liner. Embodiments provided herein enable single-trip downhole operations wherein a bottom hole assembly can be adjusted in extension length from a liner by moving and engaging a running tool at multiple locations relative to the liner. Various embodiments provided herein can be downlinkable (e.g., activated/deactivated by surface actions or instructions) or can be activated and deactivated by various triggering events (e.g., events that occur downhole and are detected and/or measured by a downhole tool, running tool, etc.).

Figure 1:
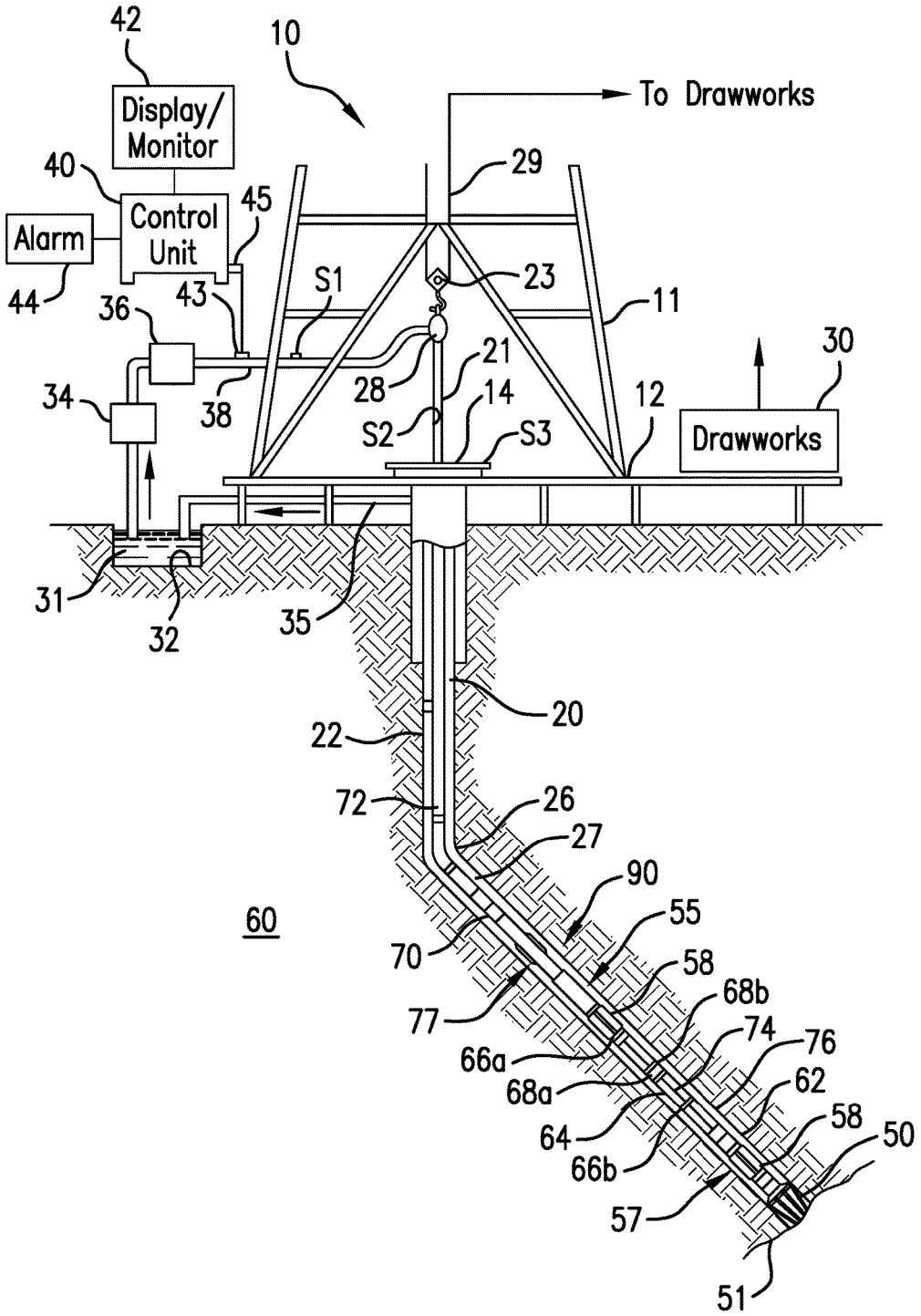
FIG. 1 is an exemplary drilling system.

FIG. 1 shows a schematic diagram of a drilling system 10 that includes a drill string 20 having a drilling assembly 90, also referred to as a bottomhole assembly (BHA), conveyed in a borehole 26 penetrating an earth formation 60. The drilling system 10 includes a conventional derrick 11 erected on a floor 12 that supports a rotary table 14 that is rotated by a prime mover, such as an electric motor (not shown), at a desired rotational speed. The drill string 20 includes a drilling tubular 22, such as a drill pipe, extending downward from the rotary table 14 into the borehole 26. A disintegrating tool 50, such as a drill bit attached to the end of the BHA 90, disintegrates the geological formations when it is rotated to drill the borehole 26. The drill string 20 is coupled to a drawworks 30 via a kelly joint 21, swivel 28 and line 29 through a pulley 23. During the drilling operations, the drawworks 30 is operated to control the weight on bit, which affects the rate of penetration. The operation of the drawworks 30 is well known in the art and is thus not described in detail herein.

During drilling operations a suitable drilling fluid 31 (also referred to as the "mud") from a source or mud pit 32 is circulated under pressure through the drill string 20 by a mud pump 34. The drilling fluid 31 passes into the drill string 20 via a desurger 36, fluid line 38, also referred to as a mud line, and the kelly joint 21. The drilling fluid 31 is discharged at the borehole bottom 51 through an opening in the disintegrating tool 50. The drilling fluid 31 circulates uphole through the annular space 27 between the drill string 20 and the borehole 26 and returns to the mud pit 32 via a return line 35. A sensor S1 in the line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide the hook load of the drill string 20 and about other desired parameters relating to the drilling of the wellbore 26. The system may further include one or more downhole sensors 70 located on the drill string 20 and/or the BHA 90.

In some applications the disintegrating tool 50 is rotated by only rotating the drill pipe 22. However, in other applications, a drilling motor 55 (mud motor) disposed in the drilling assembly 90 is used to rotate the disintegrating tool 50 and/or to superimpose or supplement the rotation of the drill string 20. In either case, the rate of penetration (ROP) of the disintegrating tool 50 into the borehole 26 for a given formation and a drilling assembly largely depends upon the weight on bit and the drill bit rotational speed. In one aspect of the embodiment of FIG. 1, the mud motor 55 is coupled to the disintegrating tool 50 via a drive shaft (not shown) disposed in a bearing assembly 57. The mud motor 55 rotates the disintegrating tool 50 when the drilling fluid 31 passes through the mud motor 55 under pressure. The bearing assembly 57 supports the radial and axial forces of the disintegrating tool 50, the downthrust of the drilling motor and the reactive upward loading from the applied weight on bit. Stabilizers 58 coupled to the bearing assembly 57 and other suitable locations act as centralizers for the lowermost portion of the mud motor assembly and other such suitable locations.

A surface control unit 40 receives signals from the downhole sensors 70 and devices via a sensor 43, also referred to as a transducer, placed in the fluid line 38 as well as from sensors S1, S2, S3, hook load sensors and any other sensors used in the system and processes such signals according to programmed instructions provided to the surface control unit 40. The surface control unit 40 displays desired drilling parameters and other information on a display/monitor 42 for use by an operator at the rig site to control the drilling operations. The surface control unit 40 contains a computer, memory for storing data, computer programs, models and algorithms accessible to a processor in the computer, a recorder, such as tape unit, memory unit, etc. for recording data and other peripherals. The surface control unit 40 also may include simulation models for use by the computer to processes data according to programmed instructions. The control unit responds to user commands entered through a suitable device, such as a keyboard. The control unit 40 is adapted to activate alarms 44 when certain unsafe or undesirable operating conditions occur.

The drilling assembly 90 also contains other sensors and devices or tools for providing a variety of measurements relating to the formation surrounding the borehole and for drilling the wellbore 26 along a desired path. Such devices may include a device for measuring the formation resistivity near and/or in front of the drill bit, a gamma ray device for measuring the formation gamma ray intensity and devices for determining the inclination, azimuth and position of the drill string. A formation resistivity tool 64, made according an embodiment described herein may be coupled at any suitable location, including above a lower kick-off subassembly 62, for estimating or determining the resistivity of the formation near or in front of the disintegrating tool 50 or at other suitable locations. An inclinometer 74 and a gamma ray device 76 may be suitably placed for respectively determining the inclination of the BHA and the formation gamma ray intensity. Any suitable inclinometer and gamma ray device may be utilized. In addition, an azimuth device (not shown), such as a magnetometer or a gyroscopic device, may be utilized to determine the drill string azimuth. Such devices are known in the art and therefore are not described in detail herein. In the above-described exemplary configuration, the mud motor 55 transfers power to the disintegrating tool 50 via a hollow shaft that also enables the drilling fluid to pass from the mud motor 55 to the disintegrating tool 50. In an alternative embodiment of the drill string 20, the mud motor 55 may be coupled below the resistivity measuring device 64 or at any other suitable place.

Still referring to FIG. 1, other logging-while-drilling (LWD) devices (generally denoted herein by numeral 77), such as devices for measuring formation porosity, permeability, density, rock properties, fluid properties, etc. may be placed at suitable locations in the drilling assembly 90 for providing information useful for evaluating the subsurface formations along borehole 26. Such devices may include, but are not limited to, acoustic tools, nuclear tools, nuclear magnetic resonance tools and formation testing and sampling tools.

The above-noted devices transmit data to a downhole telemetry system 72, which in turn transmits the received data uphole to the surface control unit 40. The downhole telemetry system 72 also receives signals and data from the surface control unit 40 and transmits such received signals and data to the appropriate downhole devices. In one aspect, a mud pulse telemetry system may be used to communicate data between the downhole sensors 70 and devices and the surface equipment during drilling operations. A transducer 43 placed in the mud line 38 detects the mud pulses responsive to the data transmitted by the downhole telemetry 72. Transducer 43 generates electrical signals in response to the mud pressure variations and transmits such signals via a conductor 45 to the surface control unit 40. In other aspects, any other suitable telemetry system may be used for two-way data communication between the surface and the BHA 90, including but not limited to, an acoustic telemetry system, an electro-magnetic telemetry system, a wireless telemetry system that may utilize repeaters in the drill string or the wellbore and a wired pipe. The wired pipe may be made up by joining drill pipe sections, wherein each pipe section includes a data communication link that runs along the pipe. The data connection between the pipe sections may be made by any suitable method, including but not limited to, hard electrical or optical connections, induction, capacitive or resonant coupling methods. In case a coiled-tubing is used as the drill pipe 22, the data communication link may be run along a side of the coiled-tubing.

The drilling system described thus far relates to those drilling systems that utilize a drill pipe to conveying the drilling assembly 90 into the borehole 26, wherein the weight on bit is controlled from the surface, typically by controlling the operation of the drawworks. However, a large number of the current drilling systems, especially for drilling highly deviated and horizontal wellbores, utilize coiled-tubing for conveying the drilling assembly downhole. In such application a thruster is sometimes deployed in the drill string to provide the desired force on the drill bit. Also, when coiled-tubing is utilized, the tubing is not rotated by a rotary table but instead it is injected into the wellbore by a suitable injector while the downhole motor, such as mud motor 55, rotates the disintegrating tool 50. For offshore drilling, an offshore rig or a vessel is used to support the drilling equipment, including the drill string.

Still referring to FIG. 1, a resistivity tool 64 may be provided that includes, for example, a plurality of antennas including, for example, transmitters 66*a* or 66*b* or and receivers 68*a* or 68*b*. Resistivity can be one formation property that is of interest in making drilling decisions. Those of skill in the art will appreciate that other formation property tools can be employed with or in place of the resistivity tool 64.

Liner drilling can be one configuration or operation used for providing a disintegrating device becomes more and more attractive in the oil and gas industry as it has several advantages compared to conventional drilling. One example of such configuration is shown and described in commonly owned U.S. Pat. No. 9,004,195, entitled "Apparatus and Method for Drilling a Wellbore, Setting a Liner and Cementing the Wellbore During a Single Trip," which is incorporated herein by reference in its entirety. Importantly, despite a relatively low rate of penetration, the time of getting the liner to target is reduced because the liner is run in-hole while drilling the wellbore simultaneously. This may be beneficial in swelling formations where a contraction of the drilled well can hinder an installation of the liner later on. Furthermore, drilling with liner in depleted and unstable reservoirs minimizes the risk that the pipe or drill string will get stuck due to hole collapse.

With a new developed system the cementing job shall be implemented in this procedure as well, reducing the process to one single run. For that, the inner string comprises a special running tool that is able to be connected in several positions. High loads due to the additional weight of the liner and also the generated torque by the friction between liner and the previously run casing or open hole result in high stressed drill string geometry. As provided herein, the design of running tools that was derived from reamers has been optimized using Finite Element Analysis.

Figure 2:
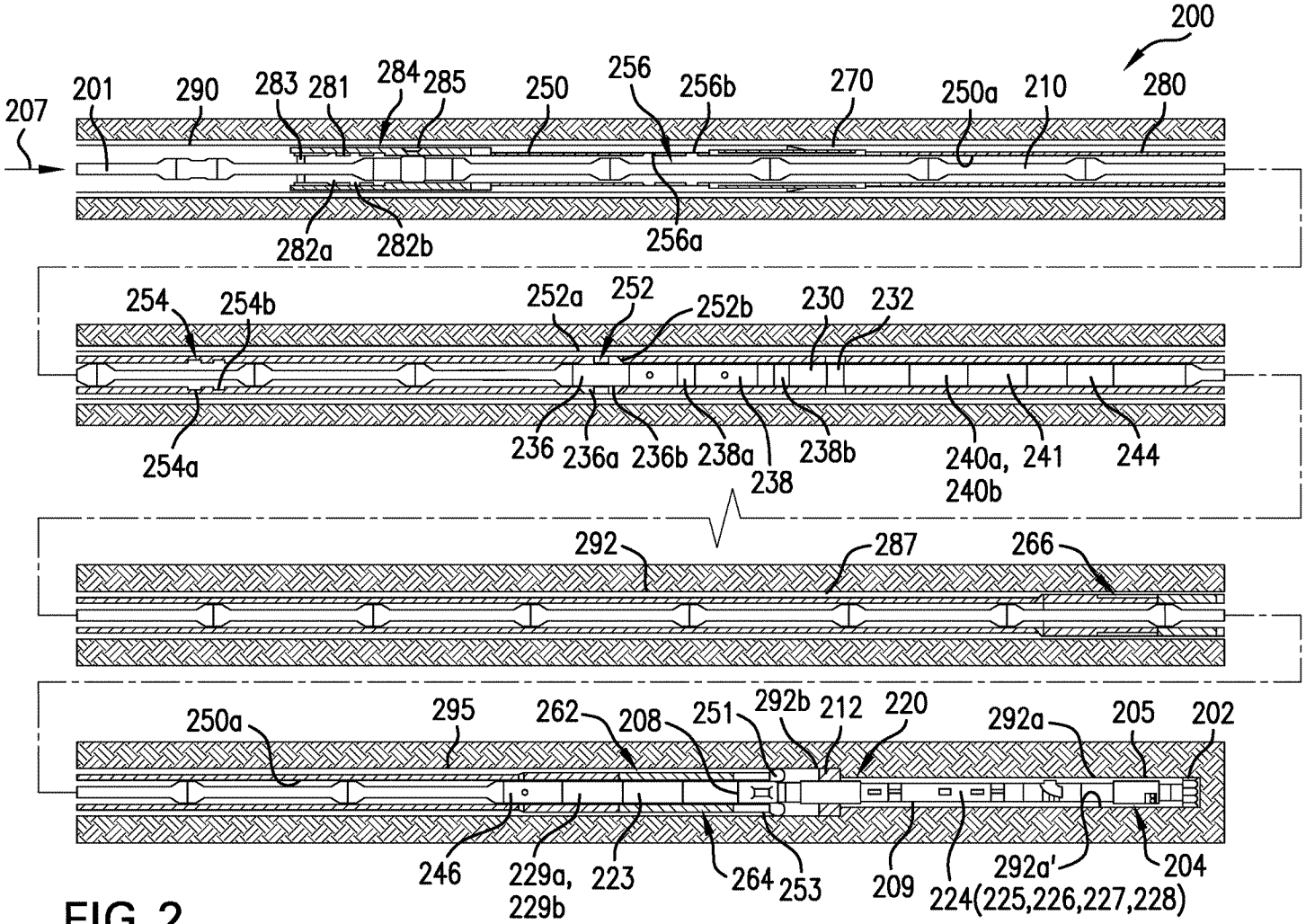
FIG. 2 is a line diagram of an exemplary drill string that includes an inner string and an outer string, wherein the inner string is connected to a first location of the outer string to drill a hole of a first size.

Turning now to FIG. 2, a schematic line diagram of an example string 200 that includes an inner string 210 disposed in an outer string 250 is shown. In this embodiment, the inner string 210 is adapted to pass through the outer string 250 and connect to the inside 250*a* of the outer string 250 at a number of spaced apart locations (also referred to herein as the "landings" or "landing locations"). The shown embodiment of the outer string 250 includes three landings, namely a lower landing 252, a middle landing 254 and an upper landing 256. The inner string 210 includes a drilling assembly or disintegrating assembly 220 (also referred to as the "bottomhole assembly") connected to a bottom end of a tubular member 201, such as a string of jointed pipes or a coiled tubing. The drilling assembly 220 includes a first disintegrating device 202 (also referred to herein as a "pilot bit") at its bottom end for drilling a borehole of a first size 292*a* (also referred to herein as a "pilot hole"). The drilling assembly 220 further includes a steering device 204 that in some embodiments may include a number of force application members 205 configured to extend from the drilling assembly 220 to apply force on a wall 292*a*' of the pilot hole 292*a* drilled by the pilot bit 202 to steer the pilot bit 202 along a selected direction, such as to drill a deviated pilot hole. The drilling assembly 220 may also include a drilling motor 208 (also referred to as a "mud motor") 208 configured to rotate the pilot bit 202 when a fluid 207 under pressure is supplied to the inner string 210.

In the configuration of FIG. 2, the drilling assembly 220 is also shown to include an under reamer 212 that can be extended from and retracted toward a body of the drilling assembly 220, as desired, to enlarge the pilot hole 292*a* to form a wellbore 292*b*, to at least the size of the outer string. In various embodiments, for example as shown, the drilling assembly 220 includes a number of sensors (collectively designated by numeral 209) for providing signals relating to a number of downhole parameters, including, but not limited to, various properties or characteristics of a formation 295 and parameters relating to the operation of the string 200. The drilling assembly 220 also includes a control circuit (also referred to as a "controller") 224 that may include circuits 225 to condition the signals from the various sensors 209, a processor 226, such as a microprocessor, a data storage device 227, such as a solid-state memory, and programs 228 accessible to the processor 226 for executing instructions contained in the programs 228. The controller 224 communicates with a surface controller (not shown) via a suitable telemetry device 229*a* that provides two-way communication between the inner string 210 and the surface controller. Furthermore, a two-way communication can be configured or installed between subcomponents of multiple parts of the BHA. The telemetry device 229*a* may utilize any suitable data communication technique, including, but not limited to, mud pulse telemetry, acoustic telemetry, electromagnetic telemetry, and wired pipe. A power generation unit 229*b* in the inner string 210 provides electrical power to the various components in the inner string 210, including the sensors 209 and other components in the drilling assembly 220. The drilling assembly 220 also may include a second or multiple power generation devices 223 capable of providing electrical power independent from the presence of the power generated using the drilling fluid 207 (e.g., third power generation device 240*b* described below).

In various embodiments, such as that shown, the inner string 210 may further include a sealing device 230 (also referred to as a "seal sub") that may include a sealing element 232, such as an expandable and retractable packer, configured to provide a fluid seal between the inner string 210 and the outer string 250 when the sealing element 232 is activated to be in an expanded state. Additionally, the inner string 210 may include a liner drive sub 236 that includes attachment elements 236*a*, 236*b* (e.g., latching elements or anchors) that may be removably connected to any of the landing locations in the outer string 250. The inner string 210 may further include a hanger activation device or sub 238 having seal members 238*a*, 238*b* configured to activate a rotatable hanger 270 in the outer string 250. The inner string 210 may include a third power generation device 240*b*, such as a turbine-driven device, operated by the fluid 207 flowing through the inner sting 210 configured to generate electric power, and a second two-way telemetry device 240*a* utilizing any suitable communication technique, including, but not limited to, mud pulse, acoustic, electromagnetic and wired pipe telemetry. The inner string 210 may further include a fourth power generation device 241, independent from the presence of a power generation source using drilling fluid 207, such as batteries. The inner string 210 may further include pup joints 244, a burst sub 246, and other components, such as, but not limited to, a release sub that releases parts of the BHA on demand or at reaching predefined load conditions.

Still referring to FIG. 2, the outer string 250 includes a liner 280 that may house or contain a second disintegrating device 251 (e.g., also referred to herein as a reamer bit) at its lower end thereof. The reamer bit 251 is configured to enlarge a leftover portion of hole 292*a* made by the pilot bit 202. In aspects, attaching the inner string at the lower landing 252 enables the inner string 210 to drill the pilot hole 292*a* and the under reamer 212 to enlarge it to the borehole of size 292 that is at least as large as the outer string 250. Attaching the inner string 210 at the middle landing 254 enables the reamer bit 251 to enlarge the section of the hole 292*a* not enlarged by the under reamer 212 (also referred to herein as the "leftover hole" or the "remaining pilot hole"). Attaching the inner string 210 at the upper landing 256, enables cementing an annulus 287 between the liner 280 and the formation 295 without pulling the inner string 210 to the surface, i.e., in a single trip of the string 200 downhole. The lower landing 252 includes a female spline 252*a* and a collet grove 252*b* for attaching to the attachment elements 236*a* and 236*b* of the liner drive sub 236. Similarly, the middle landing 254 includes a female spline 254*a* and a collet groove 254*b* and the upper landing 256 includes a female spline 256*a* and a collet groove 256*b*. Any other suitable attaching and/or latching mechanisms for connecting the inner string 210 to the outer string 250 may be utilized for the purpose of this disclosure.

The outer string 250 may further include a flow control device 262, such as a flapper valve, placed on the inside 250*a* of the outer string 250 proximate to its lower end 253. In FIG. 2, the flow control device 262 is in a deactivated or open position. In such a position, the flow control device 262 allows fluid communication between the wellbore 292 and the inside 250*a* of the outer string 250. In some embodiments, the flow control device 262 can be activated (i.e., closed) when the pilot bit 202 is retrieved inside the outer string 250 to prevent fluid communication from the wellbore 292 to the inside 250*a* of the outer string 250. The flow control device 262 is deactivated (i.e., opened) when the pilot bit 202 is extended outside the outer string 250. In one aspect, the force application members 205 or another suitable device may be configured to activate the flow control device 262.

A reverse flow control device 266, such as a reverse flapper valve, also may be provided to prevent fluid communication from the inside of the outer string 250 to locations below the reverse flow control device 266. The outer string 250 also includes a hanger 270 that may be activated by the hanger activation sub 238 to anchor the outer string 250 to the host casing 290. The host casing 290 is deployed in the wellbore 292 prior to drilling the wellbore 292 with the string 200. In one aspect, the outer string 250 includes a sealing device 285 to provide a seal between the outer string 250 and the host casing 290. The outer string 250 further includes a receptacle 284 at its upper end that may include a protection sleeve 281 having a female spline 282*a* and a collet groove 282*b*. A debris barrier 283 may also be part of the outer string to prevent cuttings made by the pilot bit 202, the under reamer 212, and/or the reamer bit 251 from entering the space or annulus between the inner string 210 and the outer string 250.

To drill the wellbore 292, the inner string 210 is placed inside the outer string 250 and attached to the outer string 250 at the lower landing 252 by activating the attachment elements 236*a*, 236*b* of the liner drive sub 236 as shown. This liner drive sub 236, when activated, connects the attachment element 236*a* to the female splines 252*a* and the attachment element 236*b* to the collet groove 252*b* in the lower landing 252. In this configuration, the pilot bit 202 and the under reamer 212 extend past the reamer bit 251. In operation, the drilling fluid 207 powers the drilling motor 208 that rotates the pilot bit 202 to cause it to drill the pilot hole 292*a* while the under reamer 212 enlarges the pilot hole 292*a* to the diameter of the wellbore 292. The pilot bit 202 and the under reamer 212 may also be rotated by rotating the drill string 200, in addition to rotating them by the motor 208.

In general, there are three different configurations and/or operations that are carried out with the string 200: drilling, reaming and cementing. In drilling a position the Bottom Hole Assembly (BHA) sticks out completely of the liner for enabling the full measuring and steering capability (e.g., as shown in FIG. 2). In a reaming position, only the first disintegrating device (e.g., pilot bit 202) is outside the liner to reduce the risk of stuck pipe or drill string in case of well collapse and the remainder of the BHA is housed within the outer string 250. In a cementing position the BHA is configured inside the outer string 250 a certain distance from the second disintegrating device (e.g., reamer bit 251) to ensure a proper shoe track.

As provided herein, one-trip drilling and reaming operations are carried out with a BHA capable of being repositioned in a liner for the drilling of the pilot hole and the subsequent reaming. In some embodiments, fully circular magnetic rings in the liner and/or the running tool provide surface information as to a position of a running tool with respect to the liner when reconnecting to the liner. Further, position sensors can confirm alignment to various recesses in the liner for attachment. Axial loads can be transmitted through the liner at spaced locations separate from torsional loads with the attachment elements (e.g., blade arrays, anchors, etc.) spaced out on the running tool. In some embodiments, an emergency release can retract the blades from the opposing recesses to allow the running tool to be removed while opening the tool for flow. Proximity sensors in conjunction with the electromagnetic field sensed by the running tool allows alignment between the blades and the liner recesses. Blades are link driven with the link having offset centers to reduce stress.

The running tool provides the connection between the inner string and the liner during steerable liner drilling. This connection, in accordance with embodiments of the present disclosure, can be infinitely engaged and released via downlinks. In some embodiments, the connection can also be established at different positions within the liner, depending on the operation that is being performed. The connection, as provided in accordance with various embodiments of the present disclosure, can be realized by the use of engagement modules (including, e.g., in one non-limiting embodiment, blade-shaped anchors) that are designed to transmit rotational forces from an over ground turning device (e.g., top drive) to the liner. The blade-shaped anchors can support both axial forces (e.g., liner weight or pushing forces acting on the liner to overcome, for example, high friction zones, etc.) and the rotational reaction forces due to the liner/formation interaction. The liner, in accordance with various embodiments, can include inner contours in order to host or receive the anchors. In summary, a downlink activated connection/transmission (e.g., the anchors) is optimized to handle or manage high loads.

Running tools as provided herein enable systems that combine drilling, reaming, liner setting, and cementing processes into a single run. The processes of setting a liner and cementing during a single trip demands for a frequent liner-drill/cementing-string connect/disconnect procedure. Running tools as provided herein can accomplish such operation through incorporation of a set of limitless extendable and retractable anchors that support and transmit axial forces (e.g., liner weight or pushing forces acting on the liner to overcome, for example, high friction zones, etc.) and torque. In some embodiments, torque anchors configured to transmit torque and/or apply pushing forces to the liner are physically or spatially separated from weight anchors configured to support the liner weight. The liner is configured with associated inner contours in order to house or receive the anchors. The number of anchors located on or at each module (e.g., torque anchor module, weight anchor module) can be different. Such difference in number(s), shape, size, latching and/or contact faces, etc. can be provided to insure proper latching and to avoid misfits.

Running tools as provided herein can be used for running cycles. One non-limiting running cycle is as follows. In order to start a new operation (such as rathole reaming or cementing) the running tool disengages. Such disengagement can be, for example, initiated or caused by a downlink and instructions or commands transmitted from the surface, triggered by internal tool sub routines, or started by gathering downhole information that reaches pre-selected thresholds. The running tool is moved to and confirms a new position within the liner. In some embodiments, the location of the running tool can be detected by a position detection system. The position detection system includes a marker and a position sensor. By way of a non-limiting example, the position may be measured by a magnetic marker/Hall sensor combination, gamma marker/detector, liner contour/acoustic sensor, or other marker/detector combination, as known in the art. At the new location, the running tool re-engages to the liner. The engagement can be caused by a downlink, triggered by internal tool sub routines, or started by gathering downhole information that reaches pre-selected thresholds. The above noted inner contours on the liner can be used for self-alignment of the running tool by engagement with the anchors. The movement and engagement amount of the anchors can be monitored, confirmed, and measured by an LVDT (linear variable differential transformer) or any inductive, capacitive, or magnetic sensor system and sent to the surface for confirmation. As such, a downhole operation can be continued with the running tool being connected to the liner at a different location than prior to movement of the running tool.

The above described position detection system may additionally include, in some embodiments, an acoustic sensor which is configured to detect an inner contour of the liner. In such configurations, identifying the location of the running tool inside the liner may be done by correlating the depth of the running tool and the inner contour of the liner.

The running tool is subject to very high forces and torques due to both its position within the drill string and the presence of the liner. By way of non-limiting example, the transmission of the torque and the axial forces from the inner string to the liner are separated in order to handle those high loads (e.g., separate torque-anchor and weight-anchor modules with separate associated anchors). In some embodiments, a complex geometry supports the weight/torque transmission. In some embodiments, the anchors are extended (or deployed) by default such that the liner cannot be lost downhole during a power/communication loss. In some non-limiting embodiments, the extending or deploying force applied to the anchors can be provided by coil springs. If power/communication cannot be re-established and the drill string is to be retrieved without the liner, the anchors can be permanently retracted by the use of a drop ball. In such an embodiment, the ball can activate a purely mechanical release mechanism powered by a circulating drilling fluid to thus retract the anchors. In some embodiments, the anchors can be pulled in by pulling the anchors against a contact surface to force the anchors to collapse inward and lose engagement between the running tool and the liner. While drop balls are used in the described embodiment of the present disclosure, the term "drop ball" also includes any other suitable object, e.g., bars, darts, plugs, and the like.

Figure 3A:
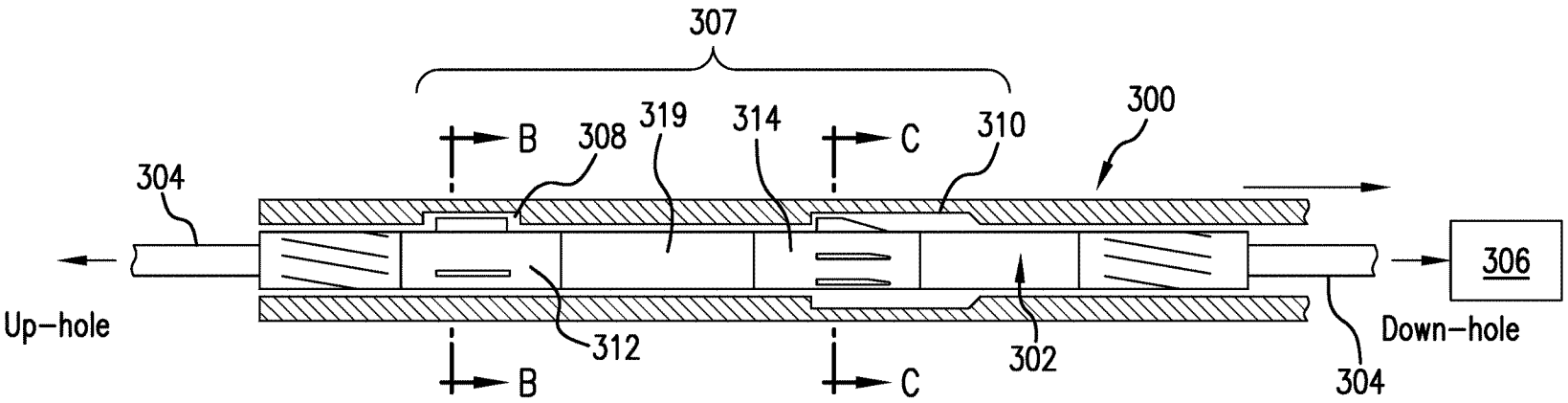
FIG. 3A is a schematic illustration of a liner and running tool in accordance with an embodiment of the present disclosure.
Figure 3C:
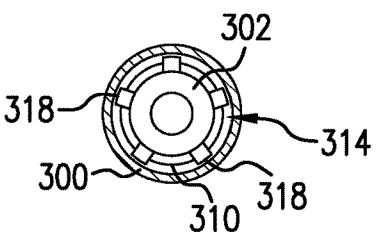
FIG. 3C is a schematic illustration of the running tool of FIG. 3A as viewed along the line C-C.
Figure 3B:
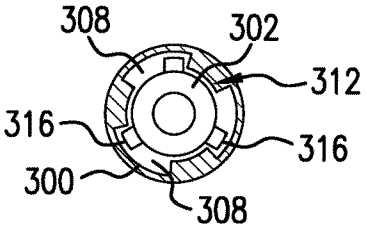
FIG. 3B is a schematic illustration of the running tool of FIG. 3A as viewed along the line B-B.

FIGS. 3A-3C illustrate various views of a liner 300 supported by a running tool 302 are shown. FIG. 3A is a side view illustration of the liner and running tool 300. FIG. 3B is a cross-sectional illustration of the liner 300 and running tool 302 as viewed along the line B-B of FIG. 3A and FIG. 3C a cross-sectional illustration of the liner 300 and running tool 302 as viewed along the line C-C of FIG. 3A.

The running tool 302 is configured on and along a string 304. The inner string 304 extends up-hole (e.g., to the left in FIG. 3A) and down-hole (e.g., to the right in FIG. 3A). Down-hole relative to the running tool 302 is a bottom hole assembly (BHA) 306. The BHA 306 can be configured and include components as described above.

To enable interaction between the liner 300 and the running tool 302, as provided in accordance with some embodiments of the present disclosure, the liner 300 includes one or more running tool engagement sections 307. As shown, the running tool engagement section 307 includes a first liner anchor cavity 308 and a second liner anchor cavity 310 that are defined as recesses or cavities formed on an interior surface of the liner 300. The liner anchor cavities 308, 310 can be axially spaced along a length of the liner 300 and/or they can be spaced in an appropriate spacing around the tool axis (e.g., equally spaced). That is, the liner anchor cavities 308, 310 are located at different positions along the length of the liner 300. The liner anchor cavities 308, 310 are sized and shaped to receive portions of the running tool 302. The liner 300 can include multiple running tool engagement sections 307 located at different distances or positions relative to a bottom end of a bore hole, and thus can enable extension of a BHA from the end of the liner to different lengths, as described herein. The running tool engagement section 307 need not include all the liner anchor cavities 308, 310, or, in other configurations, additional cavities can be provided in and/or along the liner or elsewhere as will be appreciated by those of skill in the art.

As shown, the running tool 302 may include a first engagement module 312 and a second engagement module 314 (also referred to as anchor modules). The first and second engagement modules 312, 314 are spaced apart from each other along the length of the running tool 302. The first liner anchor cavity 308 of the liner 300 is configured to receive one or more anchors of the first anchor module 312 and the second liner anchor cavity 310 of the liner 300 is configured to receive one or more anchors of the second anchor module 314. Accordingly, the spacing of the liner anchor cavities 308, 310 along the liner 300 and the spacing of the anchor modules 312, 314 can be set to allow interaction of the respective features.

The first anchor module 312 includes one or more first anchors 316 and the second anchor module 314 includes one or more second anchors 318. The anchors 316, 318 can be spaced in an appropriate spacing around the tool axis, also referred to as circumferentially spaced, and in a longitudinal direction, also referred to as axial direction or axially spaced along the length of the liner or running tool (e.g., equally spaced or unequally spaced). As shown in FIG. 3B, by way of non-limiting example, the first anchor module 312 includes three first anchors 316. Further, as shown in FIG. 3C, the second anchor module 314 includes five second anchors 318. The anchors 316, 318 of the anchor modules 312, 314 can be configured as blades or other structures as known in the art. The anchors 316, 318 are configured to be deployable or expandable to extend outward from an exterior surface of the respective module 312, 314 and engage into a respective liner anchor cavity 308, 310. Further, the anchors 316, 318 are configured to be retractable or closable to pull into the respective module 316, 318, and thus disengage from the respective module 316, 318, which enables or allows movement of the running tool 302 relative to the liner 300. Although shown with particular example numbers of anchors in each anchor module, those of skill in the art will appreciate that any number of anchors can be configured in each of the anchor modules without departing from the scope of the present disclosure.

The engagement or anchor modules 312, 314 are actuatable or operational such that the anchors or other engagable elements or features are moveable relative to the module. For example, anchors of the engagement modules can be electrically, mechanically, hydraulically, or otherwise operated to move the anchor relative to the module (e.g., radially outward from a cylindrical body). The engagement modules may be operated by combined methods, such as electro-hydraulically or electro-mechanically. In various embodiments, such as those previously mentioned, an electronics module, electronic components, and/or electronics device(s) can be used to operate the engagement module, including, but not limited to electrically driven hydraulic pumps or motors. In the simplest configuration, the electronics device can be an electrical wire, e.g., to transmit a signal, but more sophisticated components and/or modules can be employed without departing from the scope of the present disclosure. As used herein, an electronics module may be the most sophisticated electronic configuration, with electronic components either less sophisticated and/or subparts of an electronics module and an electronic device being the most basic electronic device (e.g., an electrical wire, hydraulic pump, motor, etc.). The electronic device can be a single electrical/electronic feature of the system taken alone or may be part of an electronics component and/or part of an electronics module.

Movement of the anchors may also be axial, tangential, or circumferential relative to a cylindrical module body. Actuation or operation of the engagement modules, as used herein, can be an operation that is controlled from a surface controller or can be an operation of the anchors to engage or disengage from a surface or structure in response to a pre-selected or pre-determined event or detection of pre-selected conditions or events. In some embodiments, the actuation or operation of each anchor module can be independent from the other anchor modules. In other embodiments, the actuation or operation of different anchor modules can be a dependent or predetermined sequence of actuations.

In some embodiments (depending on the module configuration) actuation can mean extension from the module into engagement with a surface that is exterior to the module (e.g., an interior surface of a liner) and/or disengagement from such surface. That is, operation/actuation can mean extension or retraction of anchors into or from engagement with a surface or structure. As noted above, in some non-limiting embodiments, the different anchors may be operated separately or collectively. The separate or collective operation can be referred to as dependent or independent operation. In the case of independent operation, for example, only a single anchor may be extended or retracted, or a particular set or number of anchors may be extended or retracted. Further, for example, a particular time-based sequence of particular or predetermined anchor extensions or retractions can be performed in order to engage or disengage with the liner.

In some embodiments, the first anchors 316 of the first module 312 can be configured to transmit torque in either direction (e.g., circumferentially) with respect to the running tool 302 or the string 304. In such a configuration, the first anchors 316 may be referred to as torque anchors and the first module 312 may be referred to as a torque anchor module. The shape of the torque anchors can allow torque transmission to the liner or liner components as well as transmitting axial forces in a downhole direction. The capability of applying axial forces in the downhole direction can be used for pushing the liner through high friction zones, to influence the set down weight of the reamer bit, to activate or to support the setting of a hanger or packer, or to activate other liner components and/or completion equipment.

The second anchors 318 of the second module 314 can be configured to transmit axial forces in an uphole direction. The capability of applying axial forces in the uphole direction can be used for carrying the liner weight and therefor to influence a set down weight of the reamer bit, to activate or to support the setting of a hanger or packer, or to activate or shear off other liner components. In such a configuration, the second anchors 318 may be referred to as weight anchors and the second module 314 may be referred to as a weight anchor module. In one non-limiting example, the second module 314 can be configured to apply set down weight to a drill bit or reamer bit and instrumentation BHA 306 for directional drilling. The string 304 continues to the surface as indicated on the left side of FIG. 3A. Those of skill in the art will appreciate that torque anchors push the liner when weight is applied and weight anchors hold the liner or pull the liner when the string is pulled.

As noted, the first anchors 316 and the second anchors 318 are selectively extendable into locations on the liner 300 (e.g., liner anchor cavities 308, 310). The liner 300 can be configured with repeated configurations of liner anchor cavities 308, 310, which can enable engagement of the running tool 302 with the liner 300 at multiple locations along the length of the liner 300. The anchors 316, 318 can latch into engagement with the liner anchor cavities 308, 310 to provide secured contact and engagement between the running tool 302 and the liner 300.

One advantage enabled by engagement of the running tool 302 at different locations along the length of the liner 300 is to have different extensions of the BHA 306 from the lower end of the liner 300 when drilling a pilot hole as opposed to reaming the pilot hole already drilled. For example, for directional drilling of a pilot hole the BHA 306 extends out more from the lower end of the liner 300 and so the running tool can be engaged at a lower (e.g., down-hole) position relative to the liner 300 than when a reamer bit is enlarging a pilot hole.

Because of the separation of the first and second modules 312, 314, the application of torque can be separated from the application of axial weight on a bit. Accordingly, stress at or on the anchors 316, 318 and/or the respective modules 312, 314 when drilling and reaming a deviated borehole can be reduced. In accordance with embodiments of the present disclosure, the anchors 316, 318 are configured to fit in respective liner anchor cavities 308, 310. Pairs of liner anchor cavities 308, 310 are located on the liner 300 at different locations with appropriate spacing relative to each other so that the anchors 316, 318 can be engaged at different locations along the liner 300 and, thus, different extensions of BHA 306 from the lower end of the liner 300 can be achieved. That is, in some embodiments, the distance between each first liner anchor cavity 308 and each second liner anchor cavity 310 of each pair of liner anchor cavities is constant. In other embodiments, the spacing may not be constant. Further, in some embodiments, the shape of a cavity along a length of a string can be different at different positions. Because the running tool 302 can be moved and located at different positions within the liner 300, and such position can be indicative of an extension of the BHA 306, it may be desirable to monitor the position of the running tool 302 within the liner 300.

In some embodiments, to enable position monitoring and/or controlled operation and/or automatic operations, the running tool 302 can include one or more electronics modules 319. The electronics module 319 can include one or more electronic components, as known in the art, to enable control of the running tool 300, such as determining the engaging and disengaging, and/or enable communication with the surface and/or with other downhole components, including, but not limited to, the BHA 306. The electronics module 319 can be part of or form a downlink that enables operation as describe herein. In other configurations, the electronics module 319 can be replaced by an electronics device, such as an electrical wire, that enables transmission of electrical signals to and/or from the running tool 302.

Figure 4A:
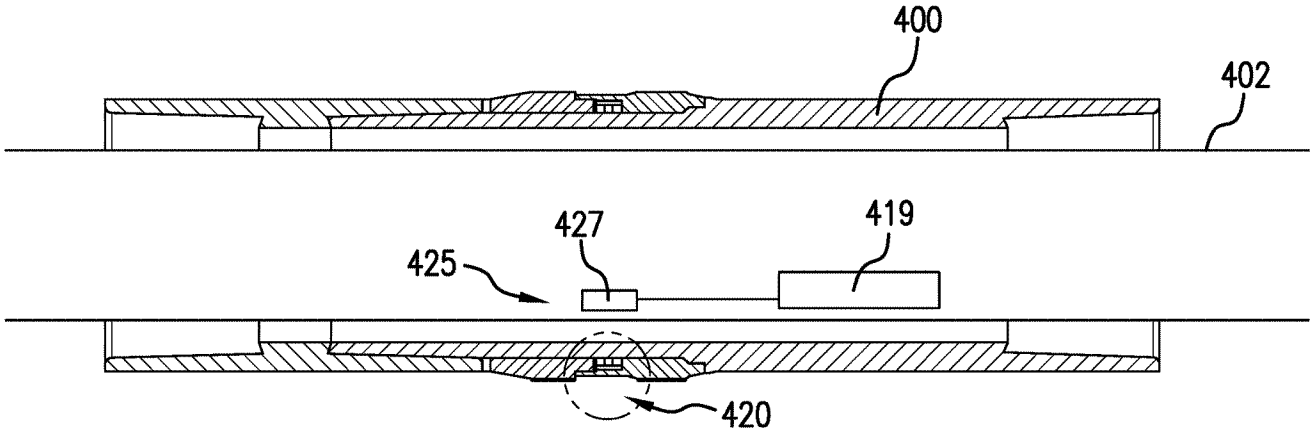
FIG. 4A is a schematic illustration of a portion of a running tool and a liner in accordance with an embodiment of the present disclosure having a position detecting system.
Figure 4B:
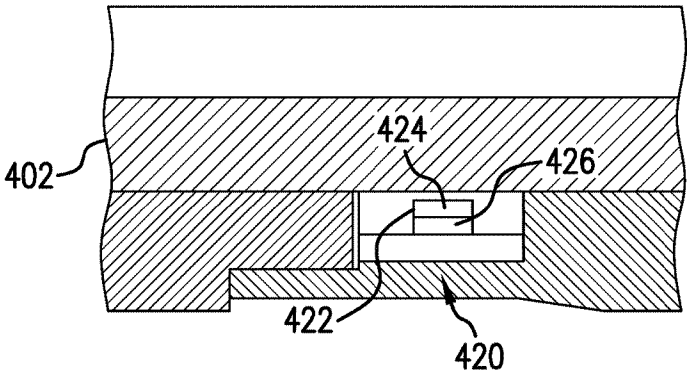
FIG. 4B is a detailed illustration of the marker of FIG. 4A.

Turning now to FIGS. 4A-4B, schematic illustrations of a liner 400 having a liner part (e.g., position marker 420) that is part of a position detection system 425 in accordance with an embodiment of the present disclosure are shown. Although shown and described in FIGS. 4A-4B with various specific components configured in and on the running tool 402 and the liner 400, those of skill in the art will appreciate that alternative configurations with the presently described components located within a liner are possible without departing from the scope of the present disclosure. In the non-limiting example, such as that shown in FIGS. 4A-4B, the liner part of the position detection system 425 is a magnetic marker.

That is, the position detection system 425 can be configured on the liners (liner 400) or running tools (running tool 402) of embodiments of the present disclosure, such as liner 300 or running tool 302 of FIG. 3A. In accordance with the embodiment of FIGS. 4A-4B, a position marker 420 is based on a magnetic ring configuration that is installed with the liner 400. However, the marker may also be located in the running tool 302. Those of skill in the art will appreciate that the position marker 420 can take any number of configurations without departing from the scope of the present disclosure. For example, magnetic markers, gamma markers, capacitive marker, conductive markers, tactile/mechanical components, etc. can be used to determine relative position between the liner and the running tool (e.g., in an axial and/or rotational manner to each other) and thus comprise one or more features of a position marker in accordance with the present disclosure. As shown, the marker is placed on the outside liner part and a sensor 427 of the detection system 425 is placed in the running tool 402. The sensor 427 is coupled to downhole electronics 419 within the running tool 402 (e.g., part of an electronics module, downlink, etc.). A sensor 427 can be a Hall sensor that detects the appearance and strength of a magnetic field. The downhole electronics 419 can be one or more electronic components that are configured in or on the running tool 402, and can be part of an electronics module (e.g., electronics module 319 of FIG. 3A). In other embodiments, an electronics device (e.g., an electrical wire) can be used instead of the downhole electronics 419.

FIG. 4A is a cross-sectional illustration of a portion of the liner 400 including the position marker 420 in accordance with an embodiment of the present disclosure. FIG. 4B is an enlarged illustration of the position marker 420 as indicated by the dashed circle in FIG. 4A.

In some embodiments, the position detection system 425 can be operably connected to or otherwise in communication with downhole electronics 419 of the running tool 402 (e.g., in some embodiments, electronics module 319 of FIG. 3A). The downhole electronics 419 of the running tool 402 can be used to communicate information to the surface, such as the position that is detected by the position detection system 425.

Properly engaging, disengaging, and moving the running tool 402 relative to the liner 400 is achieved through knowledge of the relative positions of the running tool 402 and the liner 400. By knowing the relative position of the liner 400 and the running tool 402, the anchor modules, described above, can be appropriately engaged with corresponding liner anchor cavities at different locations and thus adjustment of an extension of a BHA can be achieved. For example, the position detected by the position detection system 425 can be communicated to the surface to inform about the approximate location of the liner anchor cavity pairs relative to respective anchor modules.

In the embodiment shown in FIGS. 4A-4B, the position marker 420 includes a magnetic ring 422 that has opposed north and south poles 424, 426 as shown. In other embodiments the opposite or differing pole orientation than that shown can be used. The magnetic ring 422, in some embodiments, can be a full 360 degrees (e.g., wrap around the liner 400) or, in other embodiments, the magnetic ring 422 can be split such that less than 360 degrees is covered by the magnetic ring 422. Further, in other embodiments, the magnetic ring 422 can have overlapping ends such that the magnetic ring 422 wraps around more than 360° of the liner 400. Further still, other configurations can employ spaced magnetic buttons that form the position marker 420.

The magnetic ring 422 of the position marker 420 creates an easily detected magnetic field that can be detected and/or interact with components or features of the liner or the running tool, depending on the particular configuration.

Further, advantageously, position marker 420 as shown in FIGS. 4A-4B (e.g., magnetic rings 422) can make the orientation of the running tool 402 in and relative to a liner irrelevant in detection of a signal. Accordingly, detection of the location of a liner anchor cavity can be easily achieved, e.g., by another magnetic component located on the liner. Detection can be achieved, in part, by processing carried out on an electronics module, and such detection can be communicated to the surface. Once the detection is communicated to the surface that a magnetic marker is detected, it may be desirable to position the running tool 402 with precision so that extension of the anchors of the first and/or second anchor modules engage within respective liner anchor cavities (as described above).

Figure 5:
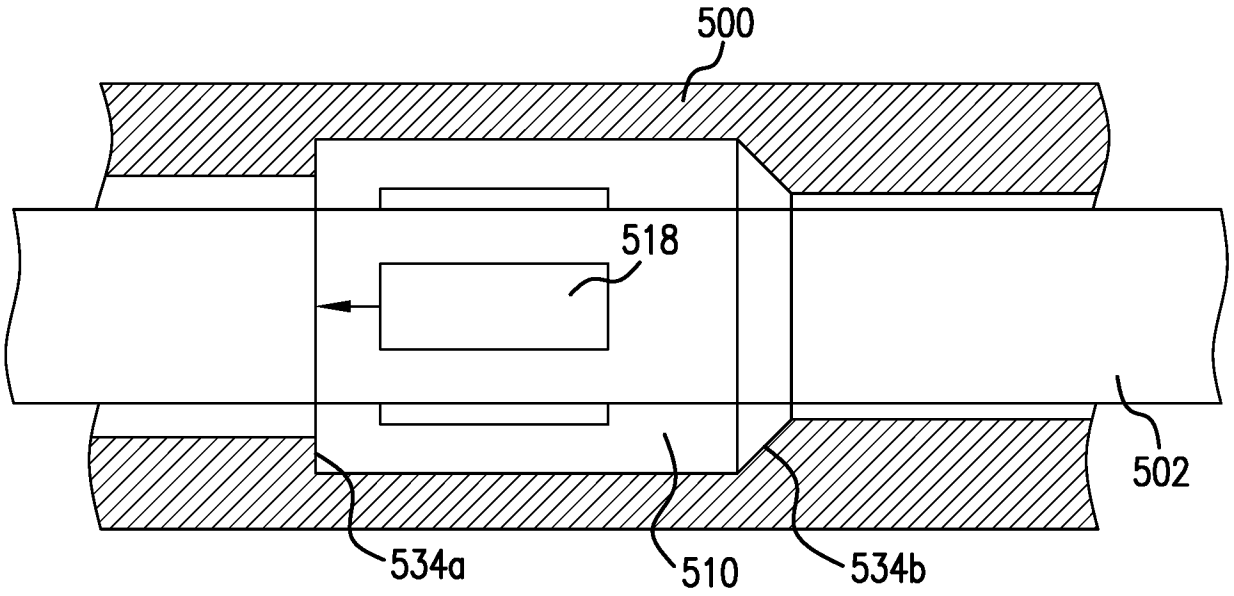
FIG. 5 is a schematic illustration of an engagement process between a running tool and a liner in accordance with an embodiment of the present disclosure.

Turning now to FIG. 5, in an embodiment weight anchors 518 may expand in a cavity 510 which may not have any torsional alignment element between the liner 500 and the running tool 502. After expanding the engagement elements the running tool 502 may be moved in an uphole direction and contact a load carrying shoulder 534*a* of the liner 500. By moving down the running tool 502 in regards to the engaged liner 500, the engaged anchors 518 may contact the lower shoulder 534*b* of the cavity 510 and may be forced to move inwards and lose the engagement between the running tool 502 and the liner 500. This may be used within normal operation or in case of an emergency, e.g., if the anchor system is out of active control.

It may be advantageous to know the precise location of the anchors and an ability to adjust to the position thereof may be desirable. For example, turning now to FIG. 6, in one non-limiting embodiment, a running tool can be configured with a position determination or measuring system 638. The system is part of a running tool having a housing 639 that is relatively stationary in position that houses a stationary part 640 of a linear variable differential transformer ("LVDT"). Moveable anchors within the running tool are coupled to an axially movable piston 641. The axially movable piston 641 can be controlled and moved by a hydraulic piston circuit, a spring, a gear (e.g., transforming rotational into axial motion), etc., as known in the art. The axially movable piston 641 is coupled to a movable part 642 of the position determination or measuring system 638. The LVDT includes a fluid filed chamber 643 which can be pressure compensated (with the pressure in the inner bore of the string).

Figure 6:
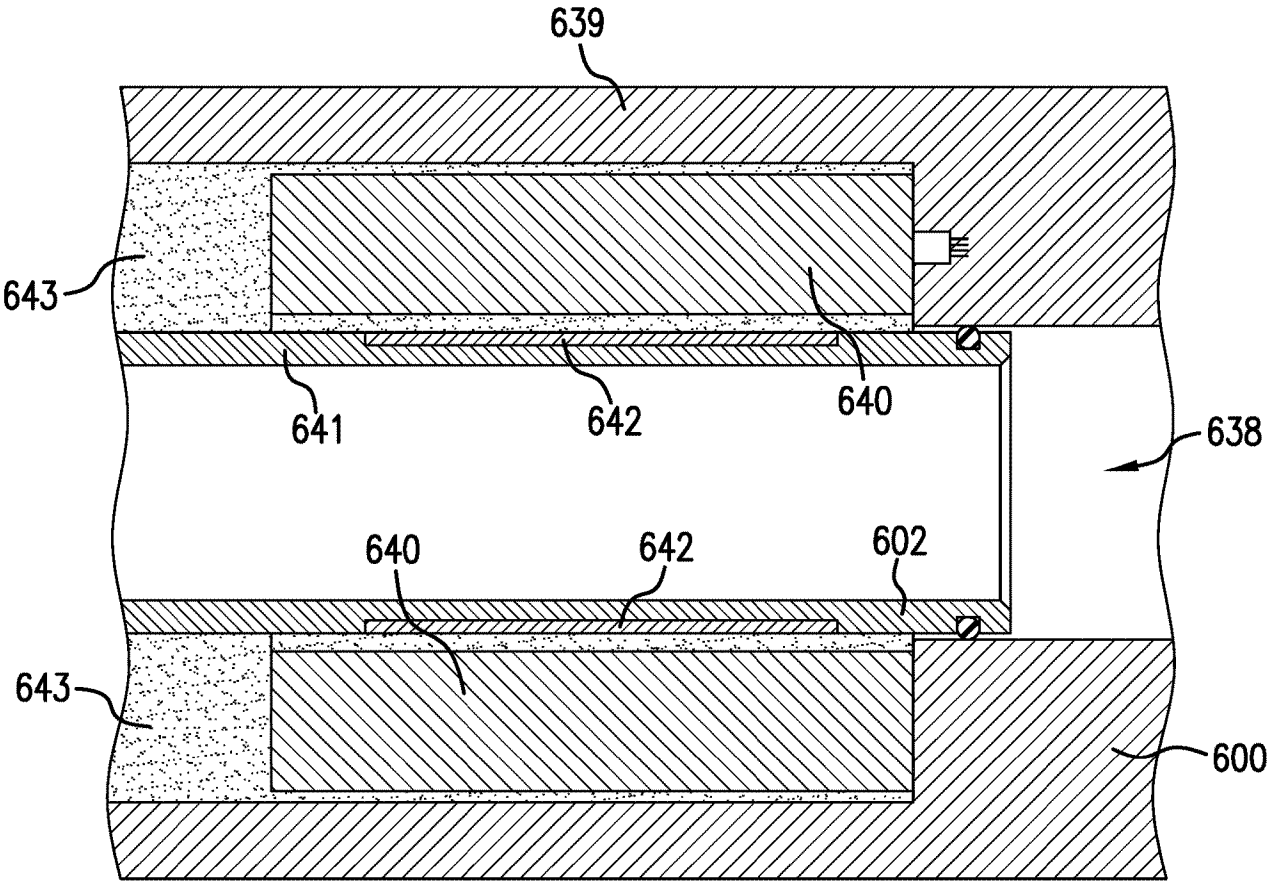
FIG. 6 is a schematic illustration of a position determination or measuring system in accordance with an embodiment of the present disclosure.

In the non-limiting embodiment of FIG. 6, the position determination or measuring system 638 is configured as a linear variable differential transformer ("LVDT"). The position determination or measuring system 638 includes a stationary part 640 (e.g., static component) and a movable part 642 (e.g., sliding component). The movable part 642 can be movable axially relative to the housing 639 and the stationary part 640. Such configuration enables monitoring and/or detection of the position of the axially movable piston 641. The position of the axially movable piston 641 is related to the position of the anchors on the running tool (e.g., as shown and described above). In one non-limiting example, the movable part 642 moves a pre-selected length to signal to the surface that the positions of the anchors are correct (e.g., full engagement within liner anchor cavities) for extension of the anchors into respective slots (e.g., slots 532) or liner anchor cavities (e.g., liner anchor cavities 308, 310).

Once the anchors are to be retracted again (after extension/engagement), the position determination or measuring system 638 is capable of confirming the full retraction by determining the new position of the LVDT. The end-stop values for maximum extension and retraction, as well as any position in-between, will be measured or determined and monitored by the downhole system (e.g., electronics modules, downhole electronics, electronic devices, etc.) and can be transmitted up-hole via a telemetry or uplink system.

The adjustment could run autonomously and also can be used for caliper applications of the surrounding components like liner, casing, or even the open hole (formation). In some embodiments, the implementation and installation of the LVDT allows mud flow to pass the system through a fluid channel through the interior of the LVDT. Furthermore, in some embodiments, the LVDT section compensates any length adjustment task within the system between the stationary and the axially moving part(s). The LVDT may be used to provide monitoring data about the position of the anchors of the present disclosure. This way the anchor position can be controlled and the extension of the anchors may be stopped at any desirable position. Accordingly, embodiments provided herein that employ an LVDT can prevent a full extension of the anchors, if desired. Various embodiments can also allow determination of a diameter such as the borehole diameter or liner diameter (caliper functionality).

Figure 7A:
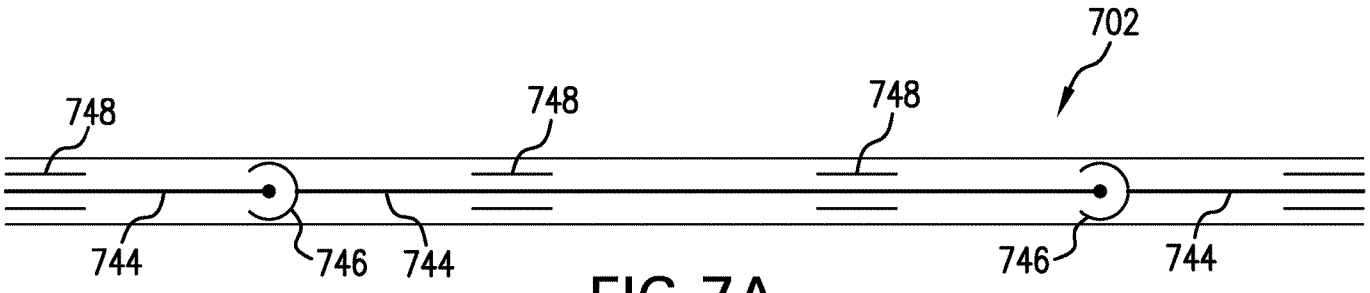
FIG. 7A is a schematic illustration of a running tool in accordance with an embodiment of the present disclosure.
Figure 7B:
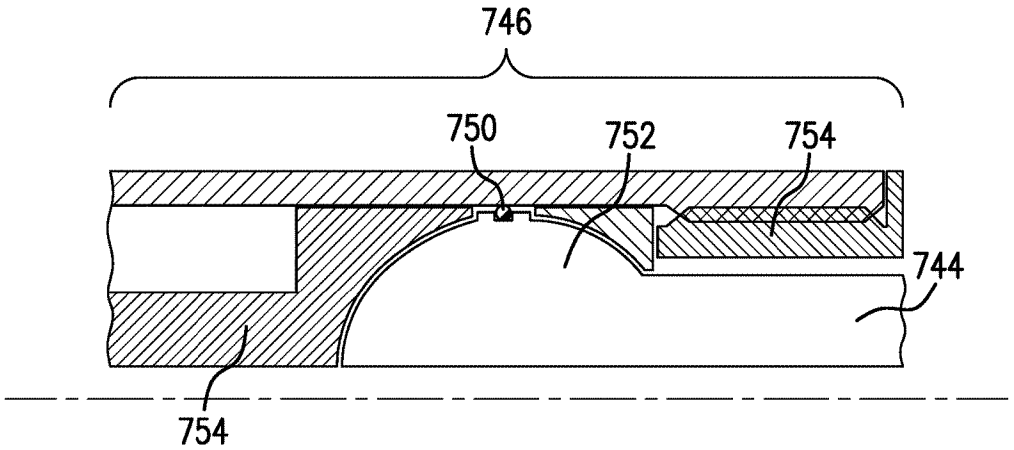
FIG. 7B is a detailed illustration of a ball joint connection of the running tool of FIG. 7A.

Turning now to FIG. 7A, a running tool 702 in accordance with an example embodiment of the present disclosure is schematically shown. The running tool 702 can be configured to run or operate within a liner or other structure, and may be subject to bending during operations downhole. To enable operation under bending conditions, running tools as provided in accordance with the present disclosure can include various features as described herein. For example, in the embodiment shown in FIG. 7, the running tool 702 includes an inner mandrel 744 that is formed of a number of segments connected by ball joints 746. The ball joints 746 and segmented nature of the inner mandrel 744 enables the running tool 702 to bend when a borehole is deviated. The number, spacing, and position of the ball joints 746 and the length of each segment of the inner mandrel 744 can be selected to enable sufficient bending in the inner mandrel 744. As shown, the running tool 702 includes a number of bushings 748. The use of the ball joints 746 can minimize binding due to severe bending when drilling or reaming FIG. 7B shows a detailed schematic illustration of a ball joint 746 in accordance with an embodiment of the present disclosure. The ball joint 746 includes a seal assembly 750 that enables a ball 752 of the ball joint 746 to rotate about an axis between ball retainers 754. Those of skill in the art will appreciate that the seal could be mounted to the ball side or the ball retainer side.

Figure 8:
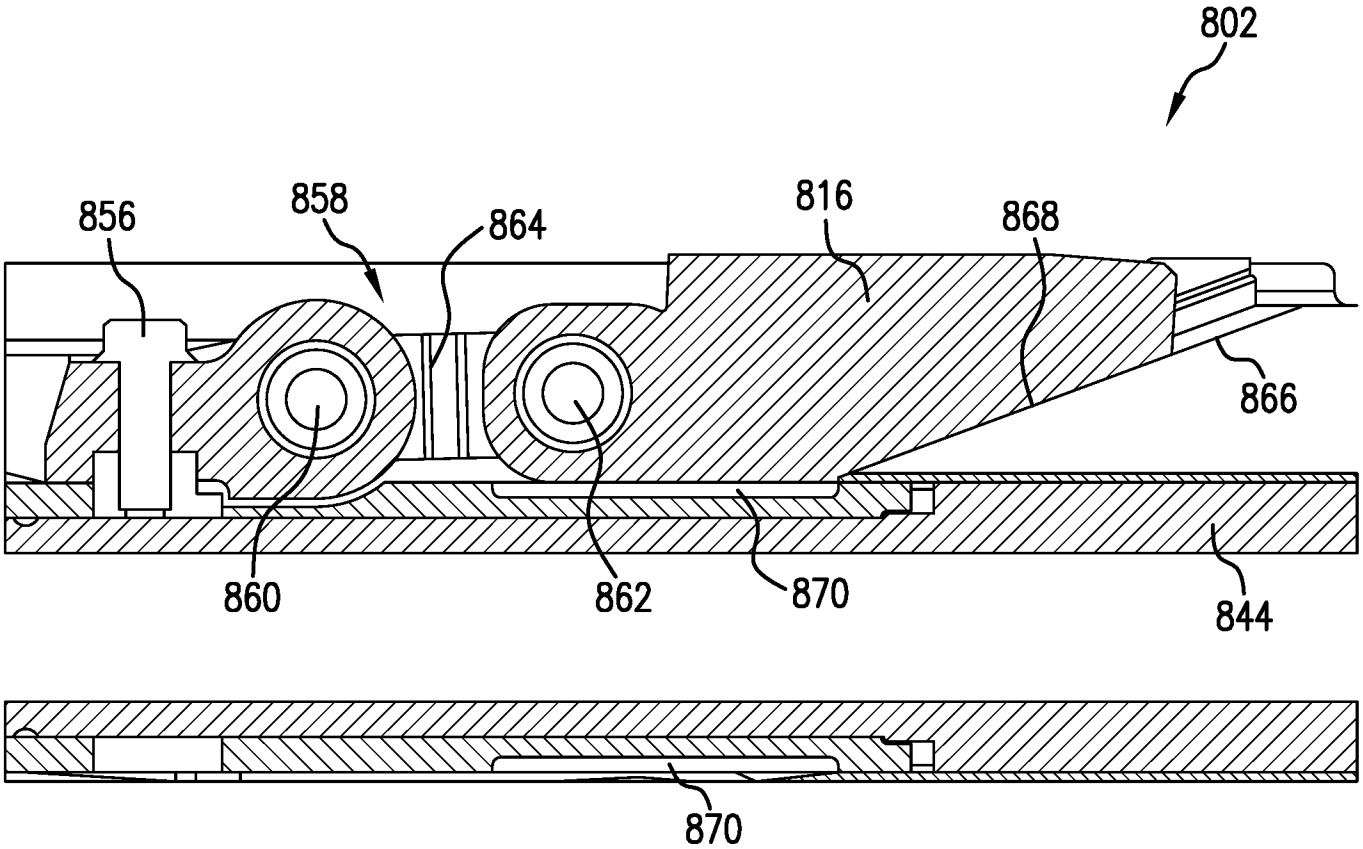
FIG. 8 is a schematic illustration of a running tool and anchor configuration in accordance with an embodiment of the present disclosure.

Referring to FIG. 8 a sectional illustration of a running tool 802 in accordance with an embodiment of the present disclosure is shown. FIG. 8 illustrates an inner mandrel 844 that is movable inside the running tool 802. The inner mandrel 844 is configured to operate one or more anchors 816 by lateral movement within the running tool 802. Accordingly, the inner mandrel 844 is operably connected to the anchor 816.

For example, the connection between the inner mandrel 844 and the anchor 816 can be achieved using a fastener 856 that retains a pivot assembly 858 to the inner mandrel 844. The pivot assembly 858 may further be connected to the anchor 816. As shown, the pivot assembly 858 includes a first link 860, a second link 862, which can be connected to or integral with the anchor 816, and a connecting arm 864 pivotally connecting the first link 860 with the second link 862. The first link 860 is fixedly connected to the inner mandrel 844 by the fastener 856.

As shown in FIG. 8, the centers of the first link 860 and the second link 862 are radially offset with respect to an axis of the inner mandrel 844. Such offset can reduce stress when actuating the anchor 816 in either of two opposed directions using pivot assembly 858. As the inner mandrel 844 moves, and thus urges the anchor 816 to move with respect to the exterior of the running tool 802, guide rails 866 on the running tool 802 are configured to receive and guide the anchor 816. That is, the guide rail 866 of the running tool 802 can receive an anchor contact surface 868 and urge the anchor 816 radially outward with respect to the axis of the inner mandrel 844. Accordingly, as the inner mandrel 844 is moved axially within the running tool 802, the pivot assembly urges the anchor 816 along the guide rail 866. The guide rails 866 can include a dovetail design to retain the anchor 816 to the outer housing of the running tool 802. As such, the anchor 816 can move outward (e.g., to engage with a liner) or inward (e.g., to disengage from a liner) within a liner anchor cavity, as described above. In some non-limiting embodiments, the pivot assembly 858 can include one or more eccentric pivots that ensure that the anchor contact surface 868 and the guide rails 866 remain aligned and in contact during engagement or disengagement. Further, an eccentric pivot can create an auto adjustment feature such that the anchors end up in the same axial position during each deployment regardless of manufacturing tolerances.

As shown, the running tool 802 can include one or more vibration dampeners 870, such as rubber elements, also referred to as rubber pads, to prevent rattling or vibration of the anchor 816 when in the retracted position. An extended or engaged position would exist when the inner mandrel 844 urges the anchor 816 to the right in FIG. 8, and the anchor 816 slides to the right and upward (e.g., radially) with respect to the running tool 802. Accordingly, the anchor 816 can extend beyond the exterior surface of the running tool 802 to engage with a liner, as described above. Those of skill in the art will appreciate that the anchor 816 of FIG. 8 can be a torque anchor or a weight anchor, as described above.

Normal operation of the anchor occurs when a surface command is issued to have the inner mandrel 844 move axially relative to the running tool 802 using known telemetry techniques. The axial movement of the inner mandrel 844 can be up-hole or down-hole. For example, in some configurations, down-hole axial movement of the inner mandrel 844 relative to the running tool 802 will cause the anchor 816 to move from the disengaged position to the engaged position where the anchor 816 extends from the running tool 802. In contrast, up-hole axial movement of the inner mandrel 844 relative to the running tool 802 can urge the anchor 816 to move from the engaged position to the disengaged position.

An automated or partially automated operation of the running tool may be employed in accordance with some non-limiting embodiments of the present disclosure. For example, all anchors and therefor the coupled mandrels can be positioned in the retracted position, which could be verified by the LVDT described above. While moving the running tool through the stationary liner the position detection system can actively detect the position of the running tool within the liner (e.g., relative to the liner). Once a signal is detected (e.g., by the LVDT), an electronics module can force a hydraulically activated mandrel and therefor the coupled anchor(s) to extend and to engage with a liner cavity. A change in hook load and the transmitted change in the LVDT measurement will demonstrate that the engagement process is complete. In some embodiments, different markers can be employed. In such configurations, for example, depending on which marker(s) are detected by the position detection system, an appropriate anchor module can be extended or otherwise operated.

Sometimes the power of the system may be lost or for some other reason the telemetry system may fail to cause disengagement and/or retraction of the anchors provided herein. If such disengagement and/or retraction does not occur, it may be difficult to remove the running tool from the borehole. Accordingly, in accordance with some embodiments, an optional release system can be used as provided herein.

Figure 9A:
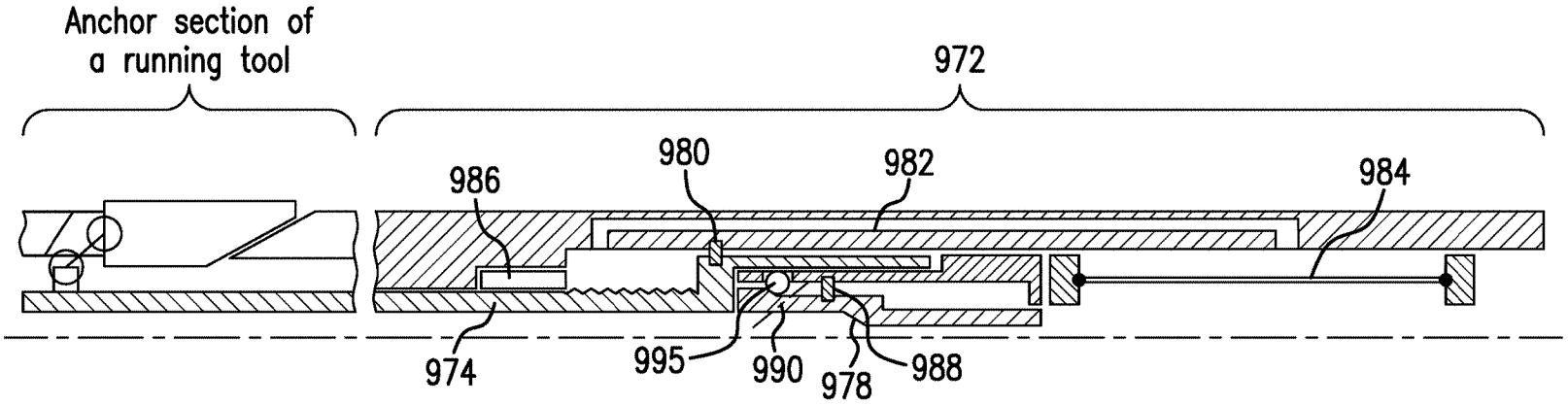
FIG. 9A is a schematic illustration of a non-activated release system that can be employed with running tools and liners of the present disclosure.
Figure 9B:
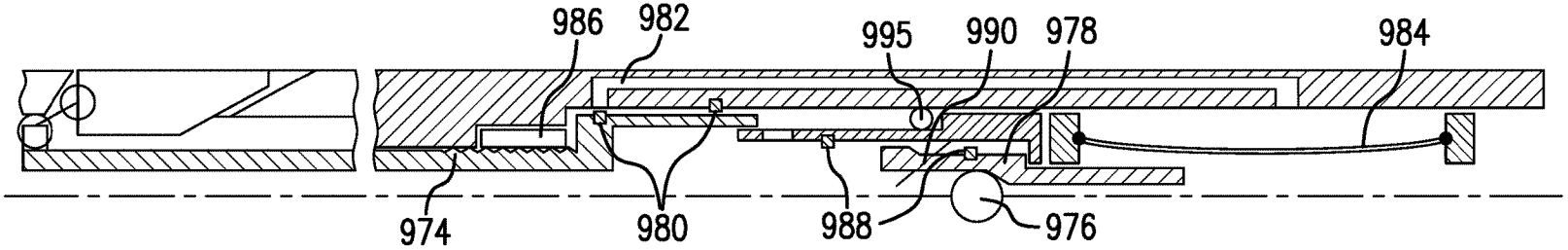
FIG. 9B is a schematic illustration of an activated release system that can be employed with running tools and liners of the present disclosure.

Referring to FIGS. 9A-9B, a release system 972 in accordance with a non-limiting embodiment of the present disclosure is shown. FIG. 9A illustrates the release system 972 in an initial state or position and FIG. 9B illustrates the release system 972 in an activated state. The release system 972 can be a part of the running tools, as described herein, or can be part of other features that are capable of interacting with running tools as described herein.

The release system 972 includes a piston 974 that is axially movable up-hole (e.g., to the left in FIGS. 9A-9B). The movement of the piston 974 can operate to push an inner mandrel of the running tool in order to retract the anchors of the running tool, such as in an emergency. The release system 972 is activated by landing a ball 976, also referred to as drop ball, on a ball seat 978 as shown in FIG. 9B. Pressure built up on the ball 976 and the pressure difference can be communicated through a fluid passage 982 bypassing the ball seat 978. The pressure build-up can operate and apply force to the piston 974 until one or more shear pins 980 break to allow the piston 974 to move up-hole (e.g., to the left in FIG. 9). One or more seals can be configured about the piston 974 to enable proper and appropriate pressure control about the piston 974.

In the configuration shown in FIG. 9B, as the piston 974 moves relative to the ball 976, the piston 974 displaces fluid into a fluid passage 982 and into a compensation unit 984 that is located down-hole from the ball 976. The compensation unit 984 can be configured to receive fluid from the relatively higher pressure side of the ball 976 (e.g., up-hole). As the fluid flows through the fluid passage 982 to the compensation unit 984, the piston 974 will move up-hole. When the ball 976 is seated on the ball seat 978, the compensation unit 984 can define a low pressure section of the release system 972.

In some configurations, the release unit 972 can include a sleeve 990 with openings for fluid passage to enable the fluid from the high pressure side to bypass the ball seat 978 to the low pressure side. The sleeve 990 can be held in place with a second layer of shear elements 988 that are configured to fail with elevated differential pressure, or a locking mechanism with, for example, balls 995. In such configuration, for example, the balls 995 can free the operation once the piston 974 has fully displaced and is secured by a lock ring 986. The lock ring 986, as known in the art, can be configured to engage with the piston 974 to prevent reverse movement of the piston 974. That is, the lock ring 986 can prevent the piston 974 from moving toward the ball 976 and ball seat 978, after the piston 974 is urged up-hole. With the piston 974 moved up-hole, the anchors of a running tool can be retracted. Further, with the piston 974 moved up-hole and an increased pressure differential, the ball seat 978 can move further downhole due to the shearing of the shear elements 988, thus opening one or more fluid passages around the ball seat 978. Thus the pressure can be equalized, enabling fluid circulation through the release system 972 and enabling pulling of the running tool.

Figure 10:
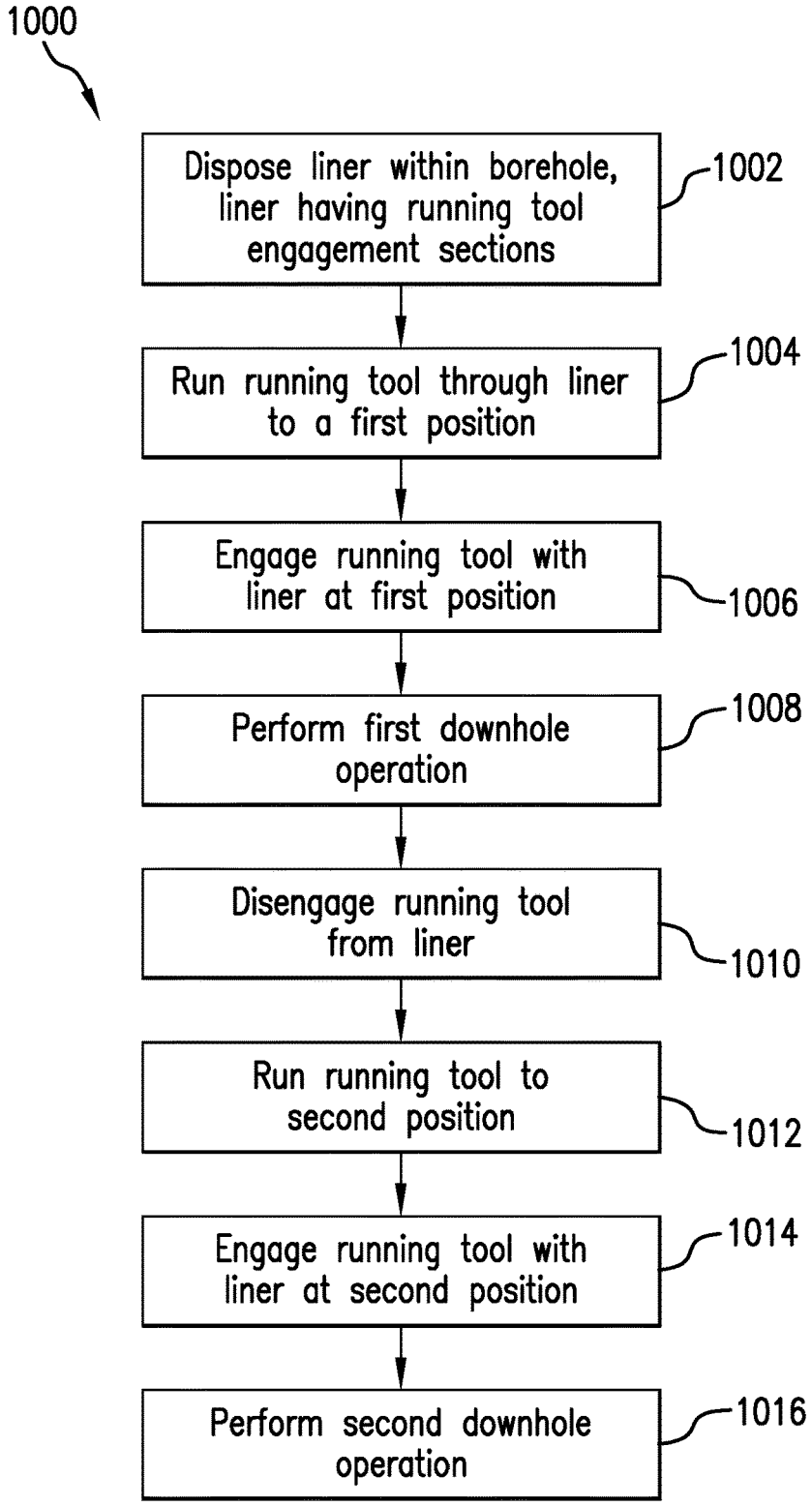
FIG. 10 is a flow process for engaging and disengaging a running tool from a liner at multiple positions in accordance with an embodiment of the present disclosure.

Turning now to FIG. 10, a flow process for engaging and disengaging a running tool within a liner in accordance with a non-limiting embodiment of the present disclosure is shown. The flow process 1000 can be carried out using embodiments described above and can include various components provided herein. The flow process 1000 is employed within a system that includes a liner having at least two running tool engagement sections (as described above) and a running tool that can be moved into, through, and within the liner. The running tool includes one or more anchor modules that include anchors that are operable to engage with the running tool engagement sections of the liner. The operation of moving the running tool from a first position within a liner to a second position within the liner and engaging thereto enables operation of a BHA at different extensions from the liner at the bottom or end of a borehole.

At block 1002, the liner is disposed in a borehole. The liner can include at least two running tool engagement sections. The running tool engagement sections can be similar to that shown and described with respect to FIG. 3A. That is, in some embodiments, the running tool engagement sections can include one or more liner anchor cavities that are configured to receive a component or portion of the running tool. The position of the running tool engagement sections can be predefined or set such that when the running tool is at a first position a BHA extends from the liner a first length and when at a second position the BHA extends from the liner a second length that is different from the first length.

At block 1004, the running tool is run into the liner to the first position. That is, the running tool is moved within the liner to the first position having a first running tool engagement section. The relative positions of the components can be measured or detected by various mechanisms as known in the art (e.g., use of a magnetic ring as described above). In some embodiments, the running tool may be engaged within the first position when the liner is disposed into the hole (thus combining block 1002 and block 1004).

At block 1006, with the running tool at the first running tool engagement section of the liner, the running tool can be actuated to engage the running tool with the liner at the first position. For example, as described above, an inner mandrel within the running tool can be moved relative to the running tool such that one or more anchors are actuated and moved into engagement with the liner. The engagement of the running tool to the liner can comprise engagement of anchors of the running tool into engagement with respective liner anchor cavities. When the running tool is engaged with the running tool engagement section of the liner, the running tool can support or transfer torque and/or weight to the BHA or the liner.

At block 1008, a first downhole operation can be performed with the BHA. For example, a first drilling operation can be carried out with the BHA extending the first length from the end of the liner.

At block 1010, after the first downhole operation is performed, the running tool can be disengaged from the liner. For example, the inner mandrel can be moved in the opposite direction than that done at block 1006, and the anchors of the running tool can be disengaged from the liner anchor cavities. After disengagement, the running tool is free to move within and/or relative to the liner.

At block 1012, the running tool is moved within and through the liner to a second position that is different from the first position. The second position can be defined by a second running tool engagement section of the liner. The configuration of the running tool engagement section at the second position can be substantially similar to the configuration of the running tool engagement section at the first position. The movement of the running tool relative to the liner can move the BHA to a different length extension from the end of the liner.

At block 1014, the running tool is engaged with the liner at the second location (i.e., with the second running tool engagement section of the liner). The engagement process can be substantially similar to that used at the first position.

At block 1016, with the running tool engaged at the second position, the BHA is extended a different length from the liner, and a second downhole operation can be performed. For example, the second downhole operation can be a second drilling operation that is configured to be used when the BHA is extended the second length.

The flow process 1000 or subparts thereof can be repeated multiple times at the first and second running tool engagement sections, or repeated to have the running tool move to and engage with additional or other running tool engagement sections of the liner. Thus, the present flow process of FIG. 10 is not intended to be limiting. For example, the engagement and disengagement procedures described herein can be initiated and/or monitored from surface via downhole telemetry, and thus related and/or associated steps or processes may be included to include such surface initiation and/or monitoring.

Advantageously, embodiments provided herein enable a one-trip liner drilling and reaming device configured to have multiple locations on the liner that a running tool can attach to allow different extension distances for a BHA. That is, liners configured with one or more liner anchor cavities configured along a length of the liner can enable a running tool to be engaged and secured at multiple locations in the liner. The different locations can enable different BHA extensions and thus enable different drilling and/or operational configurations with a single running tool. Further, in some embodiments, different anchors can be located at different locations, to thus separate torque and weight bearing and transfer sections. Moreover, different numbers of anchors can be configured on different modules such that improper or inadvertent engaging can be avoided.

Anchor systems as provided herein can apply torque or weight that apply set down weight on a bit to control local stresses at the engagement location between the running tool and the liner. Additionally, for example, torque anchors can be used to push a liner through a high friction zone. Further, running tools as provided herein can facilitate drilling and reaming of deviated boreholes. Anchor systems of the running tool as described herein can be used to activate or to support a setting of a hanger or packer or may be used for shear off operations on the liner and other completion equipment.

The implemented position determination and measurement system (e.g., LVDT) support the function of a caliper. Furthermore, the anchors can be capable to apply radial forces to a liner and/or completion equipment that can be used for activation, switching, and/or radial engagement purposes. As anchors provided here can be extended or retracted with movement of an inner mandrel in the running tool. The running tool may further include ball joints to address a potential for binding when the borehole is highly deviated. During operation and engagement, the anchors can be extended into one or more liner anchor cavities in the liner. Moreover, a pivot assembly can be used to extend and retract the anchors. In some embodiments, the pivot assembly can include components with offset centers to reduce stress of extension and retraction of the anchors and to compensate tolerances between parallel acting anchors that are coupled to the same drivetrain. In the retracted position the anchors can rest on a vibration dampener to reduce vibration or other stresses and/or forces.

Further, in some embodiments, position detection systems (e.g., including magnetic rings, gamma markers, conductive markers, capacitive markers, tactile elements, etc.) can provide efficient detection and reliable information to be supplied to the surface to identify relative positions of the running tool within a liner. Moreover, in some configurations, a release system can be configured for retracting the anchors and locking the retracted position which then enables a flow passage around a ball landed on a seat to open. Advantageously, in that manner the running tool can be removed without pulling a wet string or drilling operation can be continued. Further, such release system can be used to release a liner in case a controlled disengagement of the anchors cannot be performed.

Embodiment 1

A system for engaging and disengaging a running tool with a liner in a downhole system comprising: a liner disposed in a borehole, the liner having at least one running tool engagement section; a running tool disposed within the liner, the running tool having at least one engagement module that is operable from a disengaged position to an engaged position and that is operable from an engaged position to a disengaged position; and an electronic device disposed at least one of in or on the engagement module.

Embodiment 2

The system according to any of the present embodiments, wherein the at least one engagement module comprises at least one anchor module with one or more anchors and the at least one running tool engagement section of the liner comprises at least one liner anchor cavity, and the at least one liner anchor cavity configured to receive the one or more anchors.

Embodiment 3

The system according to any of the present embodiments, wherein the anchors of the at least one anchor module are operable independently from each other.

Embodiment 4

The system according to any of the present embodiments, wherein the one or more anchors of the at least one anchor module in the running tool are connected to the running tool by at least one eccentric pivot.

Embodiment 5

The system according to any of the present embodiments, further comprising a linear variable differential transformer configured to monitor the movement of the one or more anchors in the at least one anchor module.

Embodiment 6

The system according to any of the present embodiments, wherein monitoring the movement of the one or more anchors is used to determine a diameter.

Embodiment 7

The system according to any of the present embodiments, wherein the linear variable differential transformer comprises a fluid channel for a drilling fluid to pass the linear variable differential transformer in the running tool.

Embodiment 8

The system according to any of the present embodiments, further comprising a release system activated by a drop ball, the release system releasing the one or more anchors, the release system allowing fluid circulation after releasing the anchors.

Embodiment 9

The system according to any of the present embodiments, wherein the at least one anchor module comprises one or more vibration dampeners.

Embodiment 10

The system according to any of the present embodiments, wherein at least one of the one or more vibration dampeners is a rubber element.

Embodiment 11

The system according to any of the present embodiments, wherein the at least one engagement module comprises a first anchor module and a second anchor module, and the at least one running tool engagement section comprising a first liner anchor cavity and a second liner anchor cavity.

Embodiment 12

The system according to any of the present embodiments, wherein the first anchor module comprises one or more weight anchors and the second anchor module comprises one or more torque anchors, and the first liner anchor cavity comprises one or more weight anchor cavities configured to receive the one or more weight anchors and the second liner anchor cavity comprises one or more torque anchor cavities configured to receive the one or more torque anchors.

Embodiment 13

The system according to any of the present embodiments, wherein at least one of the one or more weight anchors or the one or more torque anchors are spaced from each other circumferentially or axially in the running tool, and the respective one or more weight anchor cavities or torque anchor cavities are spaced correspondingly in the liner.

Embodiment 14

The system according to any of the present embodiments, wherein the first anchor module and second anchor module are axially spaced along the length of the running tool, the first anchor cavity and the second anchor cavity are axially spaced along the length of the liner, and the axial spacing between the first anchor module and the second anchor module corresponds with the axial spacing of the first anchor cavity and the second anchor cavity.

Embodiment 15

The system according to any of the present embodiments, wherein the first anchor module includes first anchors and the second anchor module includes second anchors, and wherein at least one of (i) the number of the first anchors is different from the number of second anchors or (ii) the shape of the first anchors is different from the shape of the second anchors.

Embodiment 16

The system according to any of the present embodiments, wherein the running tool includes one or more ball joints configured to enable the running tool to bend within the liner.

Embodiment 17

The system according to any of the present embodiments, further comprising a telemetry system, the engaging and disengaging is initiated and monitored at surface via the telemetry system.

Embodiment 18

The system according to any of the present embodiments, wherein the liner comprises at least three running tool engagement sections.

Embodiment 19

The system according to any of the present embodiments, further comprising a position detecting system configured to detect relative positions of the liner and the running tool.

Embodiment 20

The system according to any of the present embodiments, wherein the position detection system comprises a magnetic ring.

Embodiment 21

The system according to any of the present embodiments, wherein the engagement module is configured to automatically engage or disengage based on the detected relative position.

Embodiment 22

The system according to any of the present embodiments, wherein the running tool comprises an electronics module, the electronics module determining the engaging and disengaging.

Embodiment 23

The system according to any of the present embodiments, wherein the at least one engagement module is configured to at least one of activate, push, or pull components of the liner when in the engaged position.

Embodiment 24

The system according to any of the present embodiments, further comprising a bottomhole assembly connected to the running tool, wherein the electronics module is configured to communicate with the bottomhole assembly.

Embodiment 25

A method for engaging and disengaging a running tool with a liner in a downhole system comprising: disposing a liner in a borehole, the liner having at least one running tool engagement section; disposing a running tool within the liner, the running tool having at least one engagement module that is operable from a disengaged position to an engaged position and that is operable from an engaged position to a disengaged position and an electronic device disposed at least one of in or on the engagement module; and at least one of engaging or disengaging the at least one engagement module of the running tool into the engaged position or the disengaged position with the at least one running tool engagement section.

Embodiment 26

The method according to any of the present embodiments, further comprising detecting a relative position between the liner and the running tool and automatically engaging or disengaging the at least one engagement module based on the detected relative position.

Embodiment 27

The method according to any of the present embodiments, further comprising at least one of activating, pushing, or pulling components of the liner when the engagement module is in the engaged position.

Embodiment 28

The method according to any of the present embodiments, further comprising communicating between a bottomhole assembly connected to the running tool and the electronic device.

Embodiment 29

The method according to any of the present embodiments, wherein the electronic device is part of an electronics module in the running tool, the method further comprising communicating between a bottomhole assembly connected to the running tool and the electronics module.

Embodiment 30

The method according to any of the present embodiments, further comprising establishing a downlink through the electronic device and engaging or disengaging the at least one engagement module by the downlink.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The flow diagram(s) depicted herein is just an example. There may be many variations to this diagram or the steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A system for engaging and disengaging a running tool with a liner in a downhole system comprising:

a liner disposed in a borehole, the liner having at least one running tool engagement section including one or more liner anchor cavities;

a running tool disposed within the liner, the running tool having at least one engagement module that is operable to move an anchor from a disengaged position to an engaged position and from an engaged position to a disengaged position;

an electronics module disposed at least one of in or on the at least one engagement module; and a position detection system configured to detect relative positions of the liner and the running tool, the position detection system comprising:

a marker installed within the liner; and a sensor in the running tool and configured to detect an appearance of the marker;

the position detection system configured to communicate the appearance of the marker to the electronics module, wherein, once the appearance of the marker is communicated to the electronics module, the anchor is movable into engagement with one of the one or more liner anchor cavities.

2. The system of claim 1, wherein the of the engagement module in the running tool is connected to the running tool by at least one eccentric pivot.

3. The system of claim 1, further comprising a linear variable differential transformer configured to monitor the movement of the anchor.

4. The system of claim 3, wherein monitoring the movement of the anchor is used to determine a diameter.

5. The system of claim 3, wherein the linear variable differential transformer comprises a fluid channel for a drilling fluid to pass the linear variable differential transformer in the running tool.

6. The system of claim 1, further comprising a release system activated by a drop ball, the release system releasing the anchor, the release system allowing fluid circulation after releasing the anchor.

7. The system of claim 1, wherein the running tool comprises one or more vibration dampeners.

8. The system of claim 1, wherein the at least one engagement module comprises a first anchor and a second anchor, and the at least one running tool engagement section comprises a first liner anchor cavity and a second liner anchor cavity configured to be engaged by the first and second anchors.

9. The system of claim 8, wherein the first anchor is a weight anchor and the second anchor is a torque anchor, and the first liner anchor cavity is a weight anchor cavity configured to receive the weight anchor and the second liner anchor cavity is a torque anchor cavity configured to receive the torque anchor.

10. The system of claim 8, wherein the first anchor and second anchor are axially spaced along a length of the running tool, the first anchor cavity and the second anchor cavity are axially spaced along a length of the liner, and the axial spacing between the first anchor and the second anchor corresponds with the axial spacing of the first anchor cavity and the second anchor cavity.

11. The system of claim 1, wherein the at least one engagement module comprises a first anchor module and a second anchor module, the first anchor module comprising one or more first anchors and the second anchor module comprising one or more second anchors, and wherein at least one of (i) the number of the first anchors is different from the number of second anchors or (ii) the shape of the first anchors is different from the shape of the second anchors.

12. The system of claim 1, wherein the running tool includes one or more ball joints configured to enable the running tool to bend within the liner.

13. The system of claim 1, further comprising a telemetry system, the engaging and disengaging between the engaged position and the disengaged position of the anchor is initiated and monitored at surface via the telemetry system.

14. The system of claim 1, wherein the position detection system comprises a magnetic ring.

15. The system of claim 1, wherein the running tool comprises a plurality of anchors, wherein at least two of the anchors of the plurality of anchors are operable independently from each other.

16. A method for engaging and disengaging a running tool with a liner in a downhole system comprising:

disposing a liner in a borehole, the liner having at least one running tool engagement section including one or more liner anchor cavities;

disposing a running tool within the liner, the running tool having at least one engagement module that is operable to move an anchor from a disengaged position to an engaged position and from the engaged position to the disengaged position and an electronics module disposed at least one of in or on the at least one engagement module;

detecting a relative position of the running tool relative to the liner with a position detection system, the position detection system comprising a marker installed within the liner and a sensor in the running tool configured to detect an appearance of the marker;

communicating the appearance of the marker to the electronics module; and moving the anchor into engagement with one of the one or more liner anchor cavities of the at least one running tool engagement section, using the electronics module.

17. The method of claim 16, further comprising automatically engaging or disengaging the at least one engagement module based on the detected relative position.

18. The method of claim 16, further comprising at least one of activating, pushing, or pulling components of the liner when the anchor of the at least one engagement module is in the engaged position.

19. The method of claim 16, further comprising communicating between a bottomhole assembly connected to the running tool and the electronics module.

20. The method of claim 16, further comprising establishing a downlink through the electronics module and engaging or disengaging the anchor of the at least one engagement module by the downlink.

21. A system for engaging and disengaging a running tool with a liner in a downhole system comprising:

a liner disposed in a borehole, the liner having at least one running tool engagement section;

a running tool disposed within the liner, the running tool having at least one engagement module that is operable from a disengaged position to an engaged position and that is operable from an engaged position to a disengaged position, wherein the at least one engagement module comprises at least one anchor module with one or more anchors and the at least one running tool engagement section of the liner comprises at least one liner anchor cavity, the at least one liner anchor cavity configured to receive a respective anchor of the one or more anchors;

an electronic device disposed at least one of in or on the engagement module; and a linear variable differential transformer configured to monitor the movement of the one or more anchors in the at least one anchor module, wherein the linear variable differential transformer comprises a fluid channel for a drilling fluid to pass the linear variable differential transformer in the running tool.

* * * * *